US011770886B2

(12) United States Patent
Zhou et al.

(10) Patent No.: US 11,770,886 B2
(45) Date of Patent: Sep. 26, 2023

(54) LED DRIVING CIRCUIT, LIGHT TUBE AND ILLUMINATION DEVICE

(71) Applicant: CH LIGHTING TECHNOLOGY CO., LTD., Shaoxing (CN)

(72) Inventors: Jiaming Zhou, Shaoxing (CN); Jizhong Pu, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 98 days.

(21) Appl. No.: 17/612,578

(22) PCT Filed: Mar. 8, 2021

(86) PCT No.: PCT/CN2021/079523

§ 371 (c)(1),
(2) Date: Nov. 19, 2021

(87) PCT Pub. No.: WO2021/196984

PCT Pub. Date: Oct. 7, 2021

(65) Prior Publication Data

US 2022/0240361 A1 Jul. 28, 2022

(30) Foreign Application Priority Data

Mar. 30, 2020 (CN) ..... 202010237907.5

(51) Int. Cl.
*H05B 45/3725* (2020.01)
*H05B 45/59* (2022.01)

(52) U.S. Cl.
CPC ..... *H05B 45/3725* (2020.01); *H05B 45/59* (2022.01)

(58) Field of Classification Search
None
See application file for complete search history.

(56) References Cited

U.S. PATENT DOCUMENTS 7,911,149 B2 * 3/2011 Schaible ..... H05B 45/40 315/307
10,342,077 B1 * 7/2019 Pu ..... H05B 47/26
(Continued)

FOREIGN PATENT DOCUMENTS

CN 204378381 U 6/2015
CN 104812122 A 7/2015
(Continued)

OTHER PUBLICATIONS

International Search Report issued in corresponding International application No. PCT/CN2021/079523 dated May 26, 2021.
(Continued)

*Primary Examiner* — Anh Q Tran

(57) ABSTRACT

An LED driving circuit, a light tube and an illumination device are provided. The LED driving circuit includes a first AC input end, a second AC input end, a driving module, a first protection unit, a first DC output end and a second DC output end. The first protection unit includes a voltage detection subunit and an abnormality cutoff subunit, and the voltage detection subunit is connected in parallel between two corresponding voltage nodes of the driving module, and the voltage detection subunit is configured to detect a voltage value of the driving module; and the abnormality cutoff subunit is connected in series between the second input end of the driving module and the second AC input end; the first protection unit is configured to cut off a circuit of the driving module when a voltage abnormality of the driving module is detected.

12 Claims, 6 Drawing Sheets

(56) References Cited

U.S. PATENT DOCUMENTS

| | | | | |
|---|---|---|---|---|
| 2011/0043136 | A1* | 2/2011 | Radermacher ..... | H05B 45/305<br>315/308 |
| 2016/0081147 | A1* | 3/2016 | Guang ..... | H05B 45/345<br>315/123 |

FOREIGN PATENT DOCUMENTS

| | | | |
|---|---|---|---|
| CN | 205005320 | U | 1/2016 |
| CN | 110753421 | A | 2/2020 |
| JP | 5924437 | B1 * | 5/2016 |

OTHER PUBLICATIONS

Written Opinion of the International Search Authority in corresponding International application No. PCT/CN2021/079523.

* cited by examiner

LED DRIVING CIRCUIT, LIGHT TUBE AND ILLUMINATION DEVICE

TECHNICAL HELD

The embodiments of the present invention relate to the field of illumination technology, and in particular to an LED driving circuit, a light tube and an illumination device.

BACKGROUND

Ballast mainly includes two types: instant start ballast and program start ballast. Ballast has resonance circuit, and its driving circuit is matchable with the characteristics of the load of fluorescent lamp, which outputs high frequency and high voltage (50-100 KHZ, 600-1200V) when starting. In the prior art, in order to meet the requirement of energy saving, LED light tube may be replaced by the fluorescent lamp. Because most of the lamp holder of the fluorescent lamp is a standard lamp holder, and most of the lamp holder of the LED light tube is also a standard lamp holder, the LED light tube is structurally matchable with the lamp holder of the conventional illumination device.

LED light tube includes TYPE A replacement type, TYPE B wire shearing type and TYPE A+B compatible type. Among them, TYPE A replacement type and TYPE A+B compatible type are applicable for ballast, while TYPE B wire shearing type is only applicable for AC power supply. In use of the illumination device, there will be a risk of damage and failure of the electronic components, and misapplication or misconnection of the type B wire shearing type to the ballast, as well as safety problem.

SUMMARY

Embodiments of the present invention provide an LED driving circuit, a light tube and an illumination device, to improve the safety of the illumination device.

In a first aspect, an embodiment of the present invention provides an LED driving circuit, including a first AC input end, a second AC input end, a driving module, a first protection unit, a first DC output end and a second DC output end.

The driving module includes a first input end, a second input end, a first output end and a second output end, and wherein the first input end of the driving module is electrically connected to the first AC input end, the second input end of the driving module is electrically connected to the second AC input end, the first output end of the driving module is electrically connected to the first DC output end, and the second output end of the driving module is electrically connected to the second DC output end; the driving module is configured to convert an AC voltage inputted from the first AC input end and the second AC input end into a DC voltage, and output the DC voltage through the first DC output end and the second DC output end.

The first protection unit includes a voltage detection subunit and an abnormality cutoff subunit, and wherein the voltage detection subunit is connected in parallel between two corresponding voltage nodes of the driving module, and the voltage detection subunit is configured to detect a voltage value of the driving module; and the abnormality cutoff subunit is connected in series between the second input end of the driving module and the second AC input end; the first protection unit is configured to cut off a circuit of the driving module when a voltage abnormality of the driving module is detected.

Optionally, the driving module includes a rectifying unit and a filtering unit.

The rectifying unit includes a first input end, a second input end, an output end and a grounding end, and wherein the first input end of the rectifying unit is the first input end of the driving module, the second input end of the rectifying unit is electrically connected to the second input end of the driving module, and the grounding end of the rectifying unit is electrically connected to a first earth wire.

The filtering unit includes a first input end, a second input end, a first output end and a second output end, and wherein the first input end of the filtering unit is electrically connected to the output end of the rectifying unit, the second input end of the filtering unit is electrically connected to the first earth wire, the first output end of the filtering unit is the first output end of the driving module, and the second output end of the filtering unit is the second output end of the driving module.

The voltage detection subunit is connected in parallel between the first input end and the second input end of the rectifying unit.

Alternatively, the voltage detection subunit is connected in parallel between the first output end and the second output end of the rectifying unit.

Alternatively, the voltage detection subunit is connected in parallel between the first output end and the second output end of the filtering unit.

Optionally, the voltage detection subunit includes a varistor, and temperature of the varistor increases with voltage.

Optionally, the abnormality cutoff subunit includes a temperature fuse.

Optionally, the LED driving circuit further includes a spike voltage absorbing unit which is connected between the first AC input end and the second AC input end.

Optionally, the spike voltage absorbing unit includes a first capacitor which is connected between the first AC input end and the second AC input end.

Optionally, the driving module further includes a rectifying unit, a filtering unit and a voltage regulating unit.

The rectifying unit includes a first input end, a second input end, an output end and a grounding end, and wherein the first input end of the rectifying unit is the first input end of the driving module, the second input end of the rectifying unit is electrically connected to the second input end of the driving module, and the grounding end of the rectifying unit is electrically connected to a first earth wire.

The filtering unit includes a first input end, a second input end, a first output end and a second output end, and wherein the first input end of the filtering unit is electrically connected to the output end of the rectifying unit, the second input end of the filtering unit is electrically connected to the first earth wire, the first output end of the filtering unit is the first output end of the driving module, and the second output end of the filtering unit is the second output end of the driving module.

The voltage regulating unit includes a first input end, a second input end, a first output end and a second output end, and wherein the first input end of the voltage regulating unit is electrically connected to the first output end of the filtering unit, the second input end of the voltage regulating unit is electrically connected to the second input end of the filtering unit, the first output end of the voltage regulating unit is electrically connected to the first DC output end, and the second output end of the voltage regulating unit is electrically connected to the second DC output end.

Optionally, the voltage regulating unit includes a first control chip and a transformer.

A first end of a primary coil of the transformer is electrically connected to the first output end of the filtering unit through a first diode, and a second end of the primary coil is electrically connected to the second DC output end.

A signal input end of the first control chip is electrically connected to the first end of the primary coil of the transformer, and a signal output end of the first control chip is electrically connected to the second output end of the filtering unit; the first control chip is configured to control voltage output by the voltage regulating unit.

Optionally, the driving module further includes a frequency detection unit and a switch unit; the first control chip further includes a control signal input end.

An input end of the frequency detection unit is electrically connected to the second AC input end, and a control signal output end of the frequency detection unit is electrically connected to the control signal input end of the first control chip and a control end of the switch unit.

A first end of the switch unit is electrically connected to the second end of the primary coil of the transformer, and the second end of the switch unit is electrically connected to the first earth wire.

Optionally, the LED driving circuit further includes a second protection unit which includes an input end and a grounding end, wherein the input end of the second protection unit is electrically connected to the second input end of the filtering unit; the second protection unit is configured to detect an impedance of the second input end of the filtering unit to ground; the second input end of the filtering unit is connected or disconnected to the ground depending on the detected impedance.

In a second aspect, an embodiment of that present invention also provide a light tube including a first pin, a second pin and the LED driving circuit as described in any embodiments of the present invention, wherein the first pin is electrically connected to the first AC input end of the driving circuit, and the second pin is electrically connected to the second AC input end.

In a third aspect, an embodiment of the invention also provides an illumination device including a ballast and the light tube as described in any embodiments of the present invention. The ballast includes a first connection end, a second connection end, a first output end and a second output end, and wherein the first connection end and the second connection end of the ballast are connected to a mains, the first output end of the ballast is electrically connected to the first pin of the light tube, and the second output end of the ballast is electrically connected to the second pin of the light tube.

In the embodiments of the invention, the LED driving circuit includes a first protection unit. The first protection unit includes a voltage detection subunit and an abnormality cutoff subunit, and wherein the voltage detection subunit is connected in parallel between two corresponding voltage nodes of the driving module, and the voltage detection subunit is configured to detect a voltage value of the driving module; and the abnormality cutoff subunit is connected in series between the second input end of the driving module and the second AC input end; the first protection unit is configured to cut off a circuit of the driving module when a voltage abnormality of the driving module is detected. It can be seen that the first protection unit can detect the high voltage output by the ballast through the voltage detection subunit. When the high voltage is detected for a long time, the first protection unit is capable of cutting off the input circuit of the LED driving circuit by the abnormality cutoff subunit so that the LED driving circuit stops operating, and the LED driving circuit is disconnected from the power grid, thereby disconnecting the LED driving circuit from other devices, which improves the safety of the LED driving circuit and thus the safety of the illumination device. In addition, in the present embodiments of the invention, the LED driving circuit is protected by detecting the abnormal voltage value, and the driving module is disconnected when the LED driving circuit is protected, so that the LED driving circuit is applicable to detect more abnormal conditions, and is compatible with various types of illumination device.

DESCRIPTION OF THE EMBODIMENTS

Figure 1:
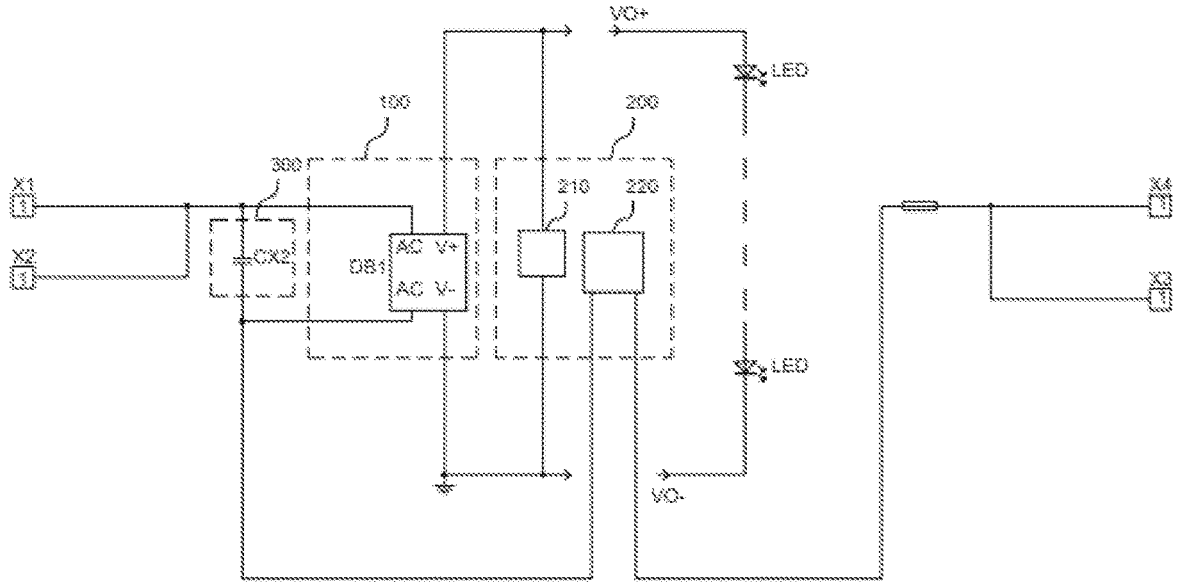
FIG. 1 is a circuit diagram of an LED driving circuit according to an embodiment of the present invention.

The invention will be further described in detail with reference to the drawings and embodiments. It should be understood that the specific embodiments described herein are for the purpose of explaining the present invention only and are not intended to limit the present invention. It should also be noted that, for ease of description, only some, but not all, of the structures related to the present invention are shown in the drawings.

According to an embodiment of the present invention, an LED driving circuit is provided. FIG. 1 is a circuit diagram of an LED driving circuit according to an embodiment of the present invention. Referring to FIG. 1, the LED driving circuit includes a first AC input end, a second AC input end, a driving module 100, a first protection unit 200, a first DC output end VO+ and a second DC output end V0−. As exemplarily shown in FIG. 1, the first AC input end includes two short-circuited connection ends, i.e., a connection end X1 and a connection end X2, and the second AC input end includes two short-circuited connection ends, i.e., a connection end X3 and a connection end X4.

The driving module 100 includes a first input end, a second input end, a first output end and a second output end. The first input end of the driving module 100 is electrically connected to the first AC input end. The second input end of the driving module 100 is electrically connected to the second AC input end. The first output end of the driving module 100 is electrically connected to the first DC output end VO+. The second output end of the driving module 100 is electrically connected to the second DC output end VO−. The driving module 100 is configured to convert the AC voltage inputted from the first AC input end and the second AC input end into a DC voltage, and output the DC voltage through the first DC output end VO+ and the second DC output end VO−.

The first protection unit 200 includes a voltage detection subunit 210 and an abnormality cutoff subunit 220. The voltage detection subunit 210 is connected in parallel between two corresponding voltage nodes of the driving module 100 for detecting the voltage value of the driving module 100. The abnormality cutoff subunit 220 is connected in series between the second input end of the driving module 100 and the second AC input end. The first protection unit 200 is configured to cut off the circuit of the driving module 100 when the voltage abnormality of the driving module 100 is detected.

The two corresponding voltage nodes of the driving module 100 refer to nodes of the driving module 100 for transmitting AC voltage or DC voltage. As an example, as shown in FIG. 1, the driving module 100 includes a first rectifying subunit DB1. The first rectifying subunit DB1 includes a first input end, a second input end, an output end and a grounding end. The first input end of the first rectifying subunit DB1 functions as the first input end of the driving module 100, and the second input end of the first rectifying subunit DB1 is electrically connected to the second input end of the driving module 100. The voltage between the first input end of the first rectifying subunit DB1 and the second input end of the first rectifying subunit DB1 is an AC voltage, and the voltage between the output end of the first rectifying subunit DB1 and the grounding end of the first rectifying subunit DB1 is a DC voltage. Therefore, the first input end of the first rectifying subunit DB1 and the second input end of the first rectifying subunit DB1 can be used as the two corresponding voltage nodes, and the output end of the first rectifying subunit DB1 and the grounding end of the first rectifying subunit DB1 can be used as the two corresponding voltage nodes. The voltage detection subunit 210 can be connected in parallel between the first input end and the second input end of the first rectifying subunit DB1 or between the output end and the grounding end of the first rectifying subunit DB1.

As an example, the first DC output end V0+ and the second DC output end V0− can be connected to LED beads of the light tube. FIG. 1 exemplarily shows a plurality of LED beads of the light tube which are connected in series. AC voltage output by a ballast is transmitted to the first AC input end and the second AC input end of the LED driving circuit. The ballast outputs high frequency and high voltage (50-100 KHZ, 600-1200V) when starting. After starting, the LED driving circuit can clamp the output voltage of the ballast at the normal working voltage of about 100V. However, in case where the electronic components of the LED driving circuit are damaged or failed or where the LED bead is damaged, the LED driving circuit could not clamp the voltage output by the ballast at the normal working voltage of about 100V. Then the high voltage of 600-1200V output by the ballast will be applied to the whole circuit for a long time until exceeding the stress of the electronic components of the LED driving circuit, so that the electronic components will suffer from overvoltage or overcurrent to generate heat and even being damaged, resulting in fire risk.

In the present embodiment of the invention, the voltage detection subunit 210 is connected in parallel between the two corresponding voltage nodes of the driving module 100 to detect the high voltage output by the ballast. When the high voltage is detected for a long time, the abnormality cutoff subunit 220 will be cut off. That is, the abnormality cutoff subunit 220 will cut off the input circuit of the LED driving circuit so that the LED driving circuit stops operating, and the LED driving circuit is disconnected from the power grid, thereby disconnecting the LED driving circuit from other devices, which improves the safety of the LED driving circuit and thus the safety of the illumination device. In addition, in the present embodiments of the invention, the LED driving circuit is protected by detecting the abnormal voltage value, and the driving module 100 is disconnected when the LED driving circuit is protected, so that the LED driving circuit is applicable to detect more abnormal conditions, and is compatible with various types of illumination devices.

Figure 2:
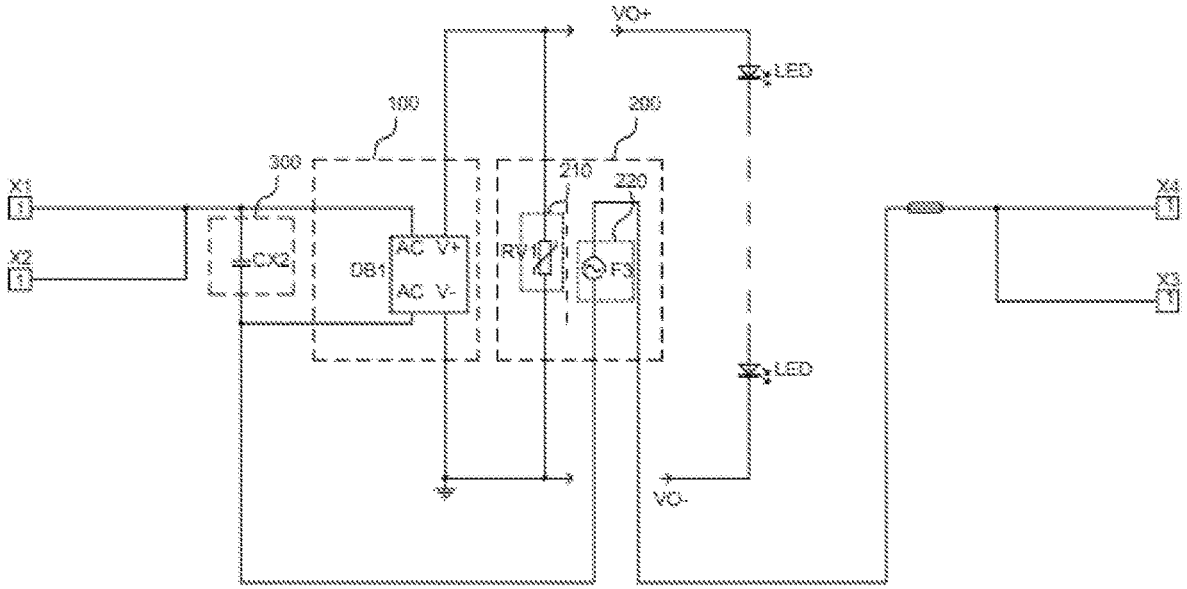
FIG. 2 is a circuit diagram of another LED driving circuit according to an embodiment of the present invention.

FIG. 2 is a circuit diagram of another LED driving circuit according to an embodiment of the present invention. Referring to FIG. 2, on the basis of the above embodiments, the voltage detection subunit 210 optionally includes a varistor RV1. The temperature of the varistor RV1 increases with the increase of the voltage, and gradually increases under a high voltage. When the ballast is started, the output high voltage of the ballast is remained for a short time, and the temperature of the varistor RV1 is low. When the output high voltage of the ballast is remained for a long time, the temperature of the varistor RV1 is high, and the abnormality cutoff subunit 220 is triggered to be cut off. In the present embodiment of the invention, the LED driving circuit has the advantages of simple structure, low cost and easy implementation.

Referring to FIG. 2 again, on the basis of the above embodiments, the abnormality cutoff subunit 220 optionally includes a temperature fuse F3. The temperature fuse F3 is also known as thermal links, and is a temperature-sensing circuit-cutoff device. The temperature fuse F3 can sense the heat generated by the varistor RV1 and the temperature of the varistor RV1. When the temperature of the varistor RV1 reaches the working temperature of the temperature fuse F3, the temperature fuse F3 is opened to cut off the input circuit of the LED driving circuit, so that the LED driving circuit stops operating. In the present embodiment of the invention, the LED driving circuit has the advantages of simple structure, low cost and easy implementation.

Referring to FIG. 1 and FIG. 2, on the basis of the above embodiments, optionally, the LED driving circuit further includes a spike voltage absorbing unit 300 that is connected between the first AC input end and the second AC input end. The spike voltage absorbing unit 300 is connected between the output lines of the ballast for absorbing the high-frequency and high-voltage spike output by the ballast when the ballast is started, so that the voltage received by the driving module 100 can be maintained within the stress range of the components of the circuit, thereby protecting the electronic components of the driving module 100 and thus further improving the safety of the LED driving circuit.

Referring to FIG. 1 and FIG. 2 again, on the basis of the above embodiments, the spike voltage absorbing unit 300 optionally includes a first capacitor CX2 connected between the first AC input end and the second AC input end. The first capacitor CX2 can pass AC and block DC, and is a non-polarised electronic component resisting high-voltage and high-current impact. When the ballast is started, the high frequency and high voltage is absorbed and coupled by the first capacitor CX2, so that the voltage flowing into the rectifying unit of the driving module 100 is greatly reduced (about 400 V). By absorbing the high-frequency and high-voltage spike through the first capacitor CX2, the output voltage of the ballast is within the stress range of the electronic components of the LED driving circuit, which advantageously prevents early failure and premature damage of the electronic components caused by high voltage.

It should be noted that, in the above embodiments, it is exemplarily shown that the voltage detection subunit 210 of the first protection unit 200 is connected in parallel between the first output end and the second output end of the first rectifying subunit DB1, which is not intended to limit the invention. In other embodiments, the voltage detection subunit 210 can be arranged at other positions. The voltage detection subunit 210 of the driving module 100 regarding the connection position thereof will be described below.

Figure 3:
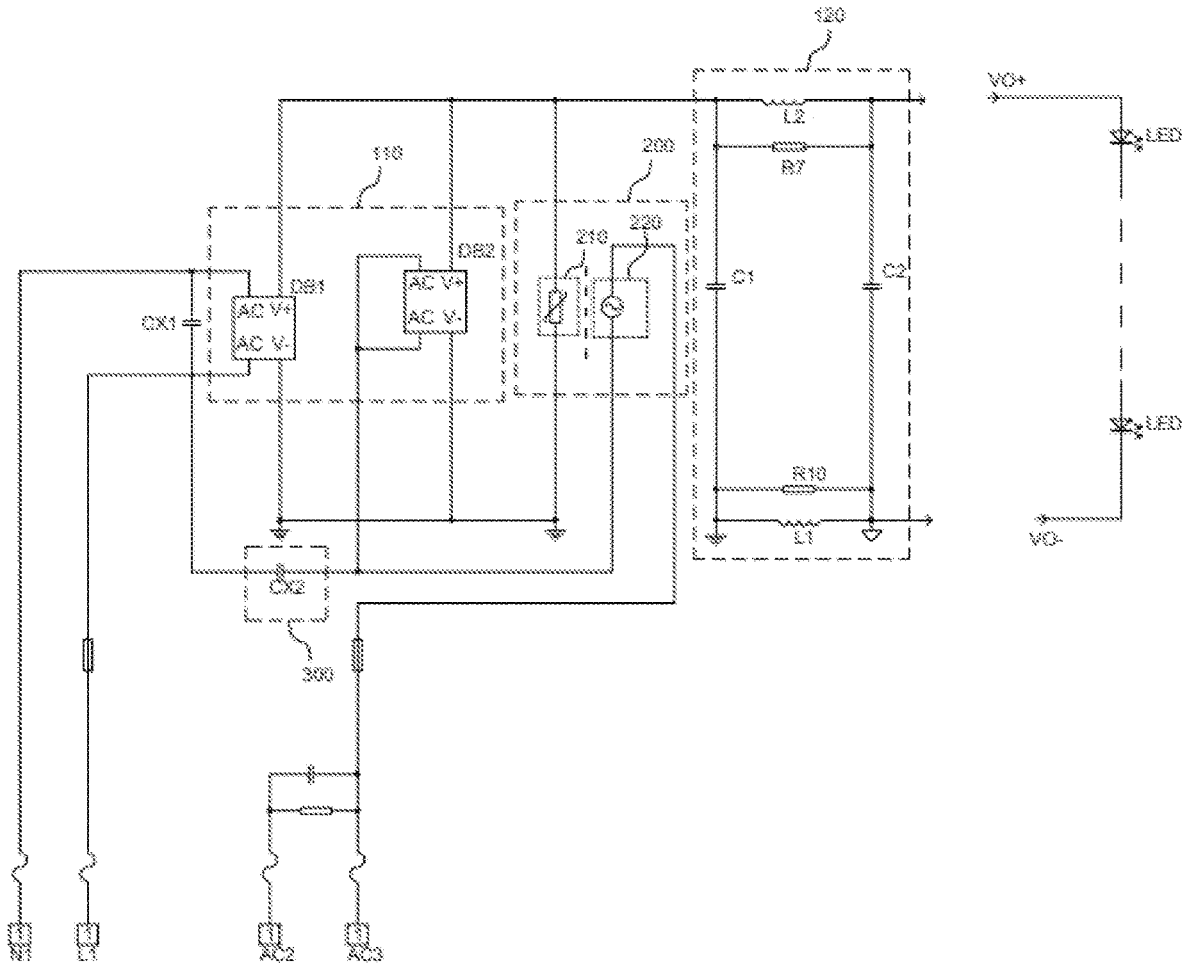
FIG. 3 is a circuit diagram of another LED driving circuit according to an embodiment of the present invention.

FIG. 3 is a circuit diagram of another LED driving circuit according to an embodiment of the present invention. Referring to FIG. 3, on the basis of the above embodiments, the driving module optionally includes a rectifying unit 110 and a filtering unit 120. The rectifying unit 110 includes a first input end, a second input end, an output end and a grounding end. The first input end of the rectifying unit 110 functions as the first input end of the driving module, the second input end of the rectifying unit 110 is electrically connected to the second input end of the driving module, and the grounding end of the rectifying unit 110 is electrically connected to a first earth wire. The filtering unit 120 includes a first input end, a second input end, a first output end and a second output end. The first input end of the filtering unit 120 is electrically connected to the output end of the rectifying unit 110, the second input end of the filtering unit 120 is electrically connected to the first earth wire, the first output end of the filtering unit 120 functions as the first output end of the driving module, and the second output end of the filtering unit 120 functions as the second output end of the driving module.

The rectifying unit 110 can be a rectifying circuit unit commonly used in the art, such as a bridge rectifier circuit unit. Optionally, the rectifying unit 110 includes a first rectifying subunit DB1 and a second rectifying subunit DB2. The first rectifying subunit DB1 includes two input ends (both input ends are denoted by AC) and two output ends denoted by V+ and V−, respectively. The two input ends of the first rectifying subunit DB1 are electrically connected to a first AC input end (denoted by L1 and N1, as shown in FIG. 3) and a second AC input end (which includes two short-circuited connection ends denoted by AC2 and AC3, respectively, as shown in FIG. 3) of the LED driving circuit, respectively. One of the two output ends of the first rectifying subunit DB1 is electrically connected to the first input end of the filtering unit 120, and the other is electrically connected to the first earth wire. The two input ends (both input ends are denoted by AC) of the second rectifying subunit DB2 are both electrically connected to the second AC input end of the LED driving circuit. One of the two output ends (denoted by V+ and V− respectively) of the second rectifying subunit DB2 is electrically connected to the first input end of the filtering unit 120, and the other is electrically connected to the first earth wire.

Optionally, the filtering unit 120 includes a second capacitor C1, a third capacitor C2, a first inductor L1, a second inductor L2, a first resistor R10, and a second resistor R7. The second capacitor C1 is electrically connected between the output end of the rectifying unit 110 and the first earth wire, and the third capacitor C2 is electrically connected between the first output end and the second output end of the filtering unit 120. The second output end of the filtering unit 120 is electrically connected to the second earth wire. The first inductor L1 and the first resistor R10 are connected in parallel. The first end of the first inductor L1 is electrically connected to the second input end of the filtering unit 120, and the second end of the first inductor L1 is electrically connected to the second earth wire. The second inductor L2 and the second resistor R7 are connected in parallel. The first end of the second inductor L2 is electrically connected to the first output end of the rectifying unit 110, and the second end of the second inductor L2 is electrically connected to the first output end of the filtering unit 120. The filtering unit 120 functions to eliminate EMI interference in the circuit.

Referring to FIG. 3 again, in one embodiment of the present invention, optionally, the voltage detection subunit 210 is connected in parallel between the first output end and the second output end of the rectifying unit 110. That is, the voltage detection subunit 210 is connected in parallel between the first output end and the second output end of the second rectifying subunit DB2. The second rectifying subunit DB2 functions to rectify and output the AC voltage inputted thereto, and the voltage outputted from the second rectifying subunit DB2 increases as the AC voltage inputted thereto. Therefore, the input AC voltage can be detected by detecting the output voltage of the second rectifying subunit DB2.

Figure 4:
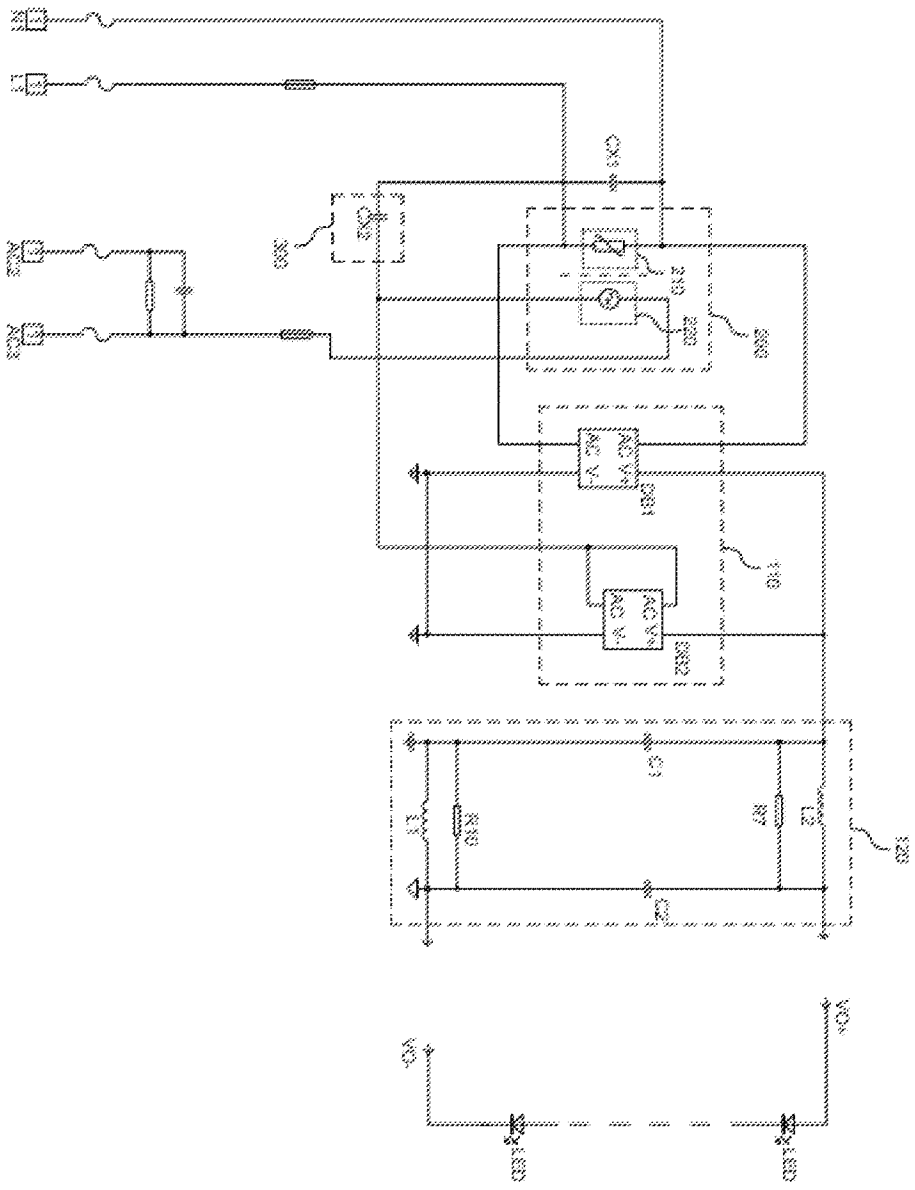
FIG. 4 is a circuit diagram of another LED driving circuit according to an embodiment of the present invention.

FIG. 4 is a circuit diagram of another LED driving circuit according to an embodiment of the present invention. Referring to FIG. 4, in an embodiment of the present invention, optionally, the voltage detection subunit 210 is connected in parallel between the first input end and the second input end of the rectifying unit 110. That is, the voltage detection subunit 210 is connected in parallel between the first input end and the second input end of the first rectifying unit 110 DB1, so as to detect the inputted AC voltage.

Figure 5:
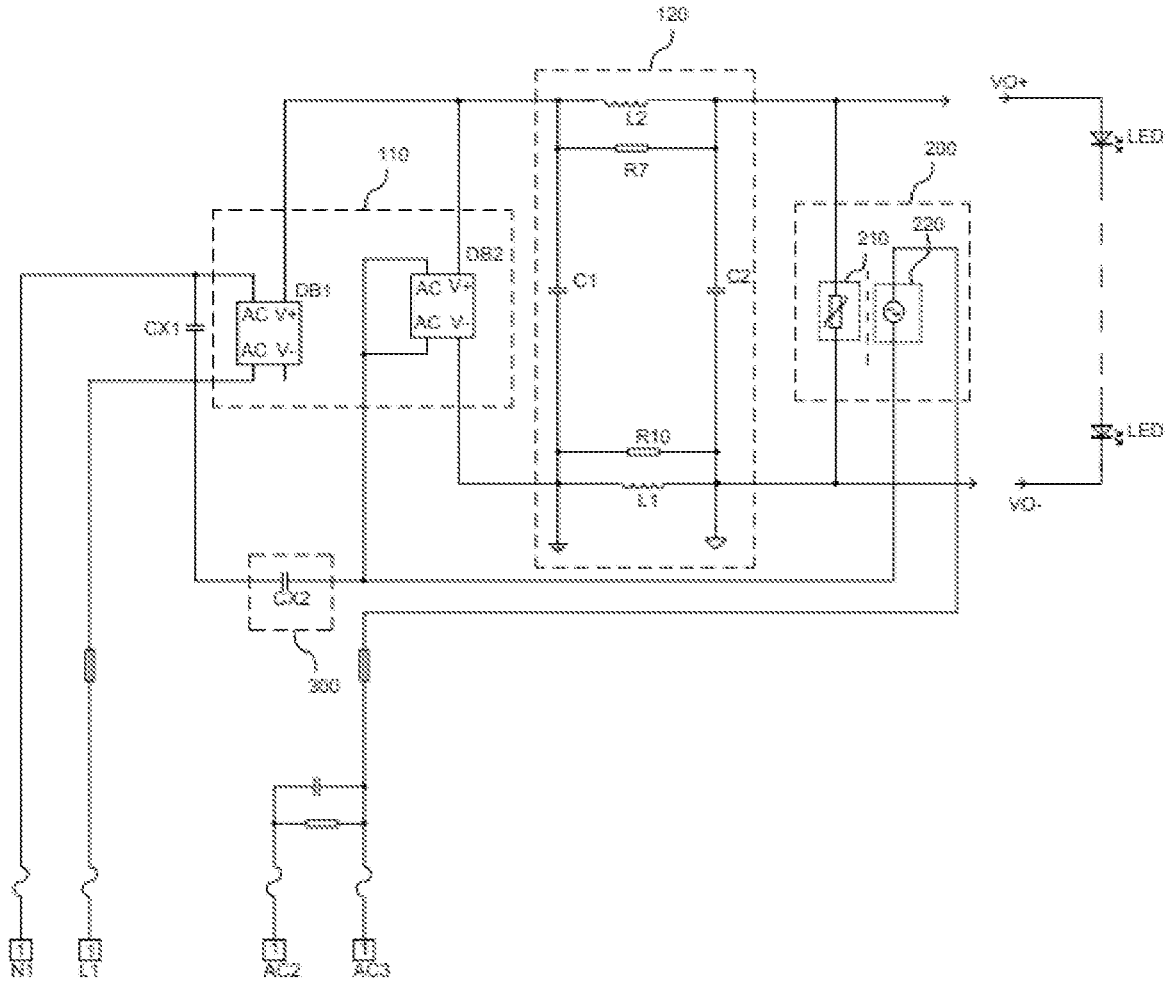
FIG. 5 is a circuit diagram of another LED driving circuit according to an embodiment of the present invention.

FIG. 5 is a circuit diagram of another LED driving circuit according to an embodiment of the present invention. Referring to FIG. 5, in an embodiment of the present invention, optionally, the voltage detection subunit 210 is connected in parallel between the first output end and the second output end of the filtering unit 120. The filtering unit 120 functions to filter the signal output by the rectifying unit 110. If the input AC voltage is higher, the voltage output by the second rectifying subunit DB2 will be higher, and then the voltage output by the filtering unit 120 will be higher. In other words, the greater the output voltage of the filtering unit 120 detected by the voltage detection subunit 210 is, the greater the input AC voltage will be. Therefore, the input AC voltage can be detected by detecting the output voltage of the filtering unit 120.

Figure 6:
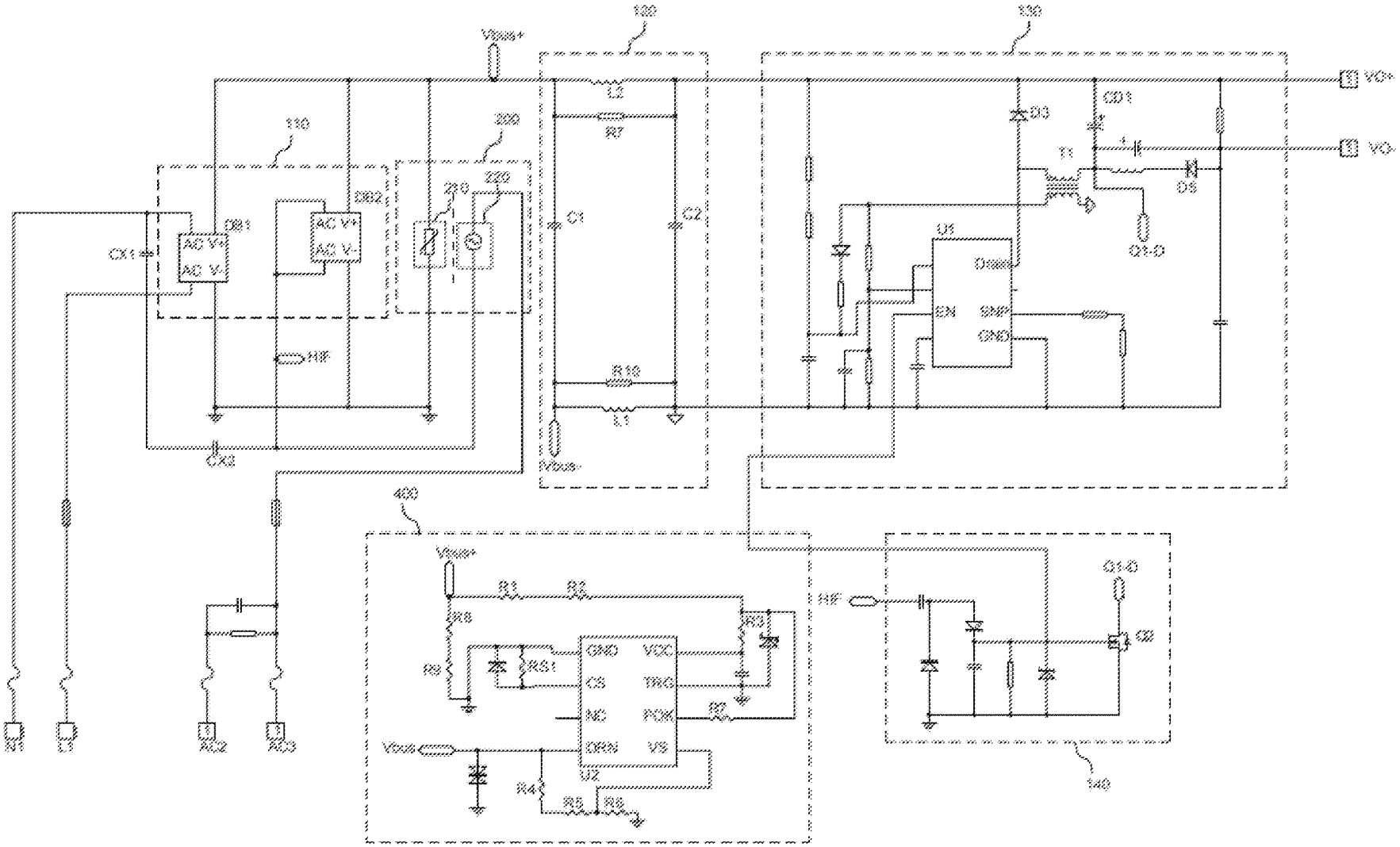
FIG. 6 is a circuit diagram of another LED driving circuit according to an embodiment of the present invention.

FIG. 6 is a circuit diagram of another LED driving circuit according to an embodiment of the present invention. Referring to FIG. 6, on the basis of the above embodiments, optionally, the driving module further includes a voltage regulating unit 130. The voltage regulating unit 130 includes a first input end, a second input end, a first output end and a second output end. The first input end of the voltage regulating unit 130 is electrically connected to the first output end of the filtering unit 120, the second input end of the voltage regulating unit 130 is electrically connected to the second output end of the filtering unit 120, the first output end of the voltage regulating unit 130 is electrically connected to the first DC output end VO+, and the second output end of the voltage regulating unit 130 is electrically connected to the second DC output end VO−. The voltage regulating unit 130 is configured to convert the DC voltage inputted from the first input end and the second input end thereof into another one or more DC voltage.

Referring to FIG. 6 again, optionally, the voltage regulating unit 130 includes a first control chip U1 and a transformer. A first end of a primary coil of the transformer is electrically connected to the first output end of the filtering unit 120 through a first diode D3, and a second end of the primary coil is electrically connected to the second DC output end VO−. A secondary coil of the transformer functions to supply power to the first control chip U1. A signal input end (hereinafter, drain end indicated as Drain) of the first control chip U1 is electrically connected to the first end of the primary coil of the transformer, a signal output end of the first control chip U1 is electrically connected to the second output end of the filtering unit 120. The first control chip U1 is configured to control the output voltage of the voltage regulating unit 130.

Specifically, the first control chip U1 can be a PWM control chip. Due to the energy storage effect of the transformer T1, the node voltage in the first control chip U1 will slowly rise. By SNP sampling and comparing with the reference voltage in the first control chip U1, when the reference voltage is reached, the first control chip U1 will send a PWM signal to cut off the switch transistor between the drain end Drain and the grounding end GND. The anode of the first diode D3 and the second earth wire are disconnected. Due to the energy storage effect of the transformer T1, the load will be further charged through the first diode D3. When the voltage for the resistance in the first control chip U1 is 0, the first control chip U1 finishes one work cycle and starts the next cycle. The transformer T1 has the function of preventing current change, so that if the switching frequency of the switch transistor in the first control chip U1 is high enough, for example, up to 50K-80K, the current can be made stable enough to allow the LED light tube to work in flicker-free.

Referring to FIG. 6 again, on the basis of the above embodiments, optionally, the driving module further includes a frequency detection unit 140 and a switch unit Q2. The first control chip U1 further includes a control signal input end EN. An input end of the frequency detection unit 140 is electrically connected to the second input end of the rectifying unit 110. The control signal output end of the frequency detection unit 140 is electrically connected to the control signal input end EN of the first control chip U1 and a control end of the switch unit Q2. A first end of the switch unit Q2 is electrically connected to the second end of the primary coil of the transformer, and the second end of the switch unit Q2 is electrically connected to the first earth wire.

The working process of the LED driving circuit will be exemplarily described here. The ballast is started and outputs high frequency and high voltage of 50-100 KHZ and 600-1200V for 100-600 milliseconds, during which, the high-frequency and high-voltage current first flows through the circuit anterior to the rectifying unit 110. The first capacitor CX2 is connected anterior to the rectifying unit 110. In other words, the first capacitor CX2 is directly connected between the output lines of the ballast. The first capacitor CX2 can pass the alternating current and block the direct current, and can resist the high-voltage and high-current impact without polarity. When the ballast is started, the high frequency and high voltage is absorbed and coupled by the first capacitor CX2, and flows into the rectifying unit 110. The voltage is greatly reduced (about 400V). After being absorbed by the first capacitor CX2, the high frequency and high voltage is within the stress range of the electronic components of the LED driving module, which advantageously prevents early failure and premature damage of the electronic components of the LED driving module caused by high voltage.

The input AC current flows through the abnormality cutoff subunit 220, and is then absorbed and coupled by the first capacitor CX2, and flows into the first rectifying subunit DB1 and the second rectifying subunit DB2 of the rectifying unit 110 to be rectified, whereby the high-frequency AC is converted into a direct current. The voltage detection subunit 210 is posterior to the second rectifying subunit DB2, the voltage detection subunit 210 does not work at a normal voltage (about 300-400 V). The current is filtered through the second capacitor, the third capacitor, the first inductor, and the second inductor, and becomes a stable direct current through the fourth capacitor CD1 (as an example, the fourth capacitor CD1 is an electrolytic capacitor), which is output via the first DC output end VO+, and input to the circuit of the LED driving circuit via the second DC output end VO−, and then flows through the second diode D5 and the transformer T1. If the frequency detection unit 140 detects the high frequency and high voltage of 50-100 KHZ and 600-1200V under the working mode of the ballast, the switch unit Q2 is directly turned on (Q1-D as shown in FIG. 6 is used to indicate the connection point of the transformer T1 and the switch unit Q2, and HIF is used to indicate the connection point of the frequency detection unit 140 and the second input end of the rectifying unit 110), the first control chip U1 does not work, the current flows through the switch unit Q2 to the ground, and then to the first earth wire of the rectifying unit 110, thereby forming a complete circuit for the LED driving circuits. If the frequency detection unit 140 detects a normal working voltage of about 100V, the first control chip U1 works via the control signal input end EN to adjust the output DC voltage, thereby forming a BUCK circuit.

In case where the LED driving circuit is out of the service life thereof, or where the LED driving circuit is opened due to the damaged electronic component or the damaged LED bead, the LED driving circuit cannot work normally and clamp the voltage, so that the ballast will output high frequency and high voltage. The high frequency and high voltage flows through the first rectifying subunit DB1 and the second rectifying subunit DB2, with the DC voltage being 600-1200V. At this time, the varistor RV1 of the voltage detection subunit 210 detects the high voltage and generates heat. When the heat and the temperature reaches the working temperature of the temperature fuse F3 of the abnormality cutoff subunit 220, the temperature fuse F3 is opened, thereby cutting off the input circuit of the LED driving circuit. The LED light tube and the circuit stop working. Therefore, the embodiments of the invention prevent the high frequency and high voltage output by the ballast from exceeding the stress of the electronic components, thereby avoiding over-voltage, over-current, heat generation and damage of the electronic components. The fire risk is avoided and the safety of the LED driving circuit is improved.

Referring to FIG. 6 again, on the basis of the above embodiments, optionally, the LED driving circuit further includes a second protection unit 400 which includes an input end and a grounding end. The input end of the second protection unit 400 is electrically connected to a second input end of the filtering unit 120. The second protection unit 400 is configured to detect an impedance of the second input end of the filtering unit 120 to ground. The second input end of the filtering unit 120 is connected or disconnected from ground depending on the detected impedance. For example, when an operator gets an electric shock, the resistance of the human body at the contact is connected to the circuit of the LED driving circuit. Specifically, a circuit is formed from the first AC input end, the rectifying unit 110, the filtering unit 120 to the human body. The impedance of the second input end of the filtering unit 120 to the first earth wire is abnormal. When the second protection unit 400 detects the impedance abnormality of the second input end of the filtering unit 120 to the first earth wire, the input end of the second protection unit 400 is disconnected from the ground, that is, the second input end of the first filtering unit 120 is disconnected from the first earth wire, and the circuit from the live wire L, the rectifying unit 110, the first filtering unit 120 to the human body is disconnected, thereby realizing electric shock protection and ensuring personal safety. Since the input end of the second protection unit 400 is disconnected from the grounding end, the circuit formed through the electric shock of the human body is cut off, thereby realizing electric shock protection.

On the basis of the embodiments described above, optionally, the second protection unit 400 includes a second control chip U2, a third resistor R1, a fourth resistor R2, a fifth resistor R3, a sixth resistor R4, a seventh resistor R5, an eighth resistor R6, a ninth resistor R7, a tenth resistor R8, an eleventh resistor R9 and a twelfth resistor RS1 (a sampling resistor). The second control chip U2 includes a power input end Vcc, a first voltage monitoring end VS, a second voltage monitoring end TRG, a current monitoring end CS, an isolation input end DRN, and a grounding end GND. The first power input end Vcc is electrically connected to the output end of the rectifying unit 110 through the third resistor R1, the fourth resistor R2 and the fifth resistor R3. The first voltage monitoring end VS is electrically connected to the isolation input end DRN through the sixth resistor R4, the seventh resistor R5 and the eighth resistor R6. The current monitoring end CS is electrically connected to the first earth wire through the twelfth resistor RS1. The second control chip U2 can control the circuit between the isolation input end DRN thereof and the grounding end GND thereof to be turned on or off (Vbus− in FIG. 6 is used to indicate the connection point between the isolation input end DRN and the second input end of the filtering unit 120, and by Vbus+ is used to indicate the connection point between the second protection unit 400 and the second output end of the rectifying unit 110).

Illustratively, the first pow input end Vcc normally receives the working voltage, and when the light tube works normally, the current monitoring end CS of the second control chip U2 constantly collects the current between the second input end of the filtering unit 120 and the first earth wire (Vbus− in FIG. 6 is used to indicate the signal at the second input end of the filtering unit 120), and the first voltage monitoring end VS and the second voltage monitoring end TRG constantly collect the voltage between the second input end of the filtering unit 120 and the first earth wire, thereby calculating the power grid impedance between the second input of the filtering unit 120 and the first earth wire. If the impedance is determined to be within the normal range, the isolation input end DRN and the current monitoring end Cs are connected, and the current flows through the sampling resistor at the current monitoring end Cs and is connected to the first earth wire. On the contrary, if the impedance is determined to be within the abnormal range, the isolation input end DRN is disconnected from the current monitoring end Cs, and the second input end of the filtering unit 120 is disconnected from the first earth wire, thereby realizing electric shock protection and ensuring personal safety.

In the embodiments of the invention, the LED driving circuit itself can realize the electric shock protection, and once the electric shock is detected, the whole circuit can be cut off, thereby reducing the potential risk when a user uses the light tube, and thus further improving the safety of the LED driving circuit.

Figure 7:
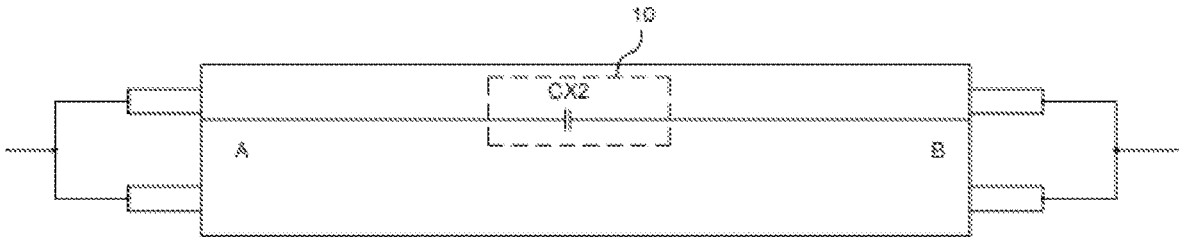
FIG. 7 is a schematic structural diagram of a light tube according to an embodiment of the present invention.

According to an embodiment of the present invention, a light tube is further provided, which can be, for example, an LED straight tube light or a U tube light. FIG. 7 is a schematic structural diagram of a light tube according to an embodiment of the present invention. Referring to FIG. 7, the light tube includes a first pin A, a second pin B and the LED driving circuit 10 according to any embodiments of the present invention. The first pin A is electrically connected to a first AC input end of the driving circuit, and the second pin B is electrically connected to the second AC input end. The light tube according to the embodiment of the present invention includes the LED driving circuit 10 according to any embodiments of the present invention as described above, and therefore the technical principle and the advantages thereof will not be described in detail.

Figure 8:
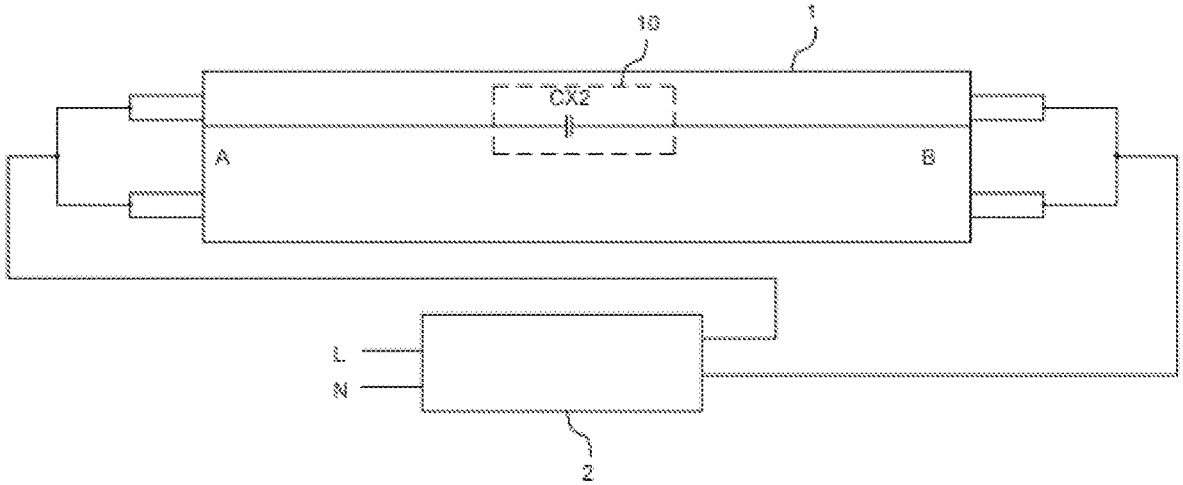
FIG. 8 is a schematic structural diagram of an illumination device according to an embodiment of the present invention.

According to an embodiment of the present invention, an illumination device is further provided. FIG. 8 is a schematic structural diagram of an illumination device according to an embodiment of the present invention. Referring to FIG. 8, the illumination device includes a ballast 2 and a light tube 1 according to any embodiments of the present invention. The ballast 2 includes a first connection end L, a second connection end N, a first output end, and a second output end. The first connection end L and the second connection end N of the ballast 2 are connected to the mains (e.g., AC120-277V/60 HZ). The first output end of the ballast 2 is electrically connected to the first pin of the light tube, and the second output end of the ballast 2 is electrically connected to the second pin of the light tube. The ballast 2 includes at least one of an electronic ballast and an inductive ballast. The illumination device according to the embodiment of the present invention includes the LED driving circuit according to any embodiments of the present invention as described above, and therefore the technical principle and the advantages thereof will not be described in detail.

It should be noted that the above embodiments only show the preferred embodiments of the present invention and the preferred technical principle thereof. Those skilled in the art will appreciate that the present invention is not limited to the specific embodiments described herein, and the various obvious changes, readjustments and substitutions can be made by those skilled in the art without departing from the scope of protection of the present invention. Therefore, although the present invention has been described in detail through the above embodiments, the present invention is not limited only to the above embodiments, but can include other equivalent embodiments without departing from the inventive concept. The scope of the invention is determined by the scope of the appended claims.

What is claimed is:

1. An LED driving circuit, comprising a first AC input end, a second AC input end, a driving module, a first protection unit, a first DC output end and a second DC output end, wherein the driving module comprises a first input end, a second input end, a first output end and a second output end, and wherein the first input end of the driving module is electrically connected to the first AC input end, the second input end of the driving module is electrically connected to the second AC input end, the first output end of the driving module is electrically connected to the first DC output end, and the second output end of the driving module is electrically connected to the second DC output end; the driving module is configured to convert an AC voltage inputted from the first AC input end and the second AC input end into a DC voltage, and output the DC voltage through the first DC output end and the second DC output end; and the first protection unit comprises a voltage detection subunit and an abnormality cutoff subunit, and wherein the voltage detection subunit is connected in parallel between two corresponding voltage nodes of the driving module, and the voltage detection subunit is configured to detect a voltage value of the driving module; and the abnormality cutoff subunit is connected in series between the second input end of the driving module and the second AC input end; the first protection unit is configured to cut off a circuit of the driving module when a voltage abnormality of the driving module is detected.

2. The LED driving circuit according to claim 1, wherein the driving module comprises a rectifying unit and a filtering unit; wherein the rectifying unit comprises a first input end, a second input end, an output end and a grounding end, and wherein the first input end of the rectifying unit is the first input end of the driving module, the second input end of the rectifying unit is the second input end of the driving module, and the grounding end of the rectifying unit is electrically connected to a first earth wire; and the filtering unit comprises a first input end, a second input end, a first output end and a second output end, and wherein the first input end of the filtering unit is electrically connected to the output end of the rectifying unit, the second input end of the filtering unit is electrically connected to the first earth wire, the first output end of the filtering unit is the first output end of the driving module, and the second output end of the filtering unit is the second output end of the driving module; and wherein the voltage detection subunit is connected in parallel between the first input end and the second input end of the rectifying unit, or, the voltage detection subunit is connected in parallel between the first output end and the second output end of the rectifying unit, or, the voltage detection subunit is connected in parallel between the first output end and the second output end of the filtering unit.

3. The LED driving circuit according to claim 1, wherein the voltage detection subunit comprises a varistor, and temperature of the varistor increases with voltage.

4. The LED driving circuit according to claim 1, wherein the abnormality cutoff subunit comprises a temperature fuse.

5. The LED driving circuit according to claim 1, further comprising a spike voltage absorbing unit which is connected between the first AC input end and the second AC input end.

6. The LED driving circuit according to claim 5, wherein the spike voltage absorbing unit comprises a first capacitor which is connected between the first AC input end and the second AC input end.

7. The LED driving circuit according to claim 1, wherein the driving module further comprises a rectifying unit, a filtering unit and a voltage regulating unit; wherein the rectifying unit comprises a first input end, a second input end, an output end and a grounding end, and wherein the first input end of the rectifying unit is the first input end of the driving module, the second input end of the rectifying unit is the second input end of the driving module, and the grounding end of the rectifying unit is electrically connected to a first earth wire;

the filtering unit comprises a first input end, a second input end, a first output end and a second output end, and wherein the first input end of the filtering unit is electrically connected to the output end of the rectifying unit, the second input end of the filtering unit is electrically connected to the first earth wire, the first output end of the filtering unit is the first output end of the driving module, and the second output end of the filtering unit is the second output end of the driving module; and the voltage regulating unit comprises a first input end, a second input end, a first output end and a second output end, and wherein the first input end of the voltage regulating unit is electrically connected to the first output end of the filtering unit, the second input end of the voltage regulating unit is electrically connected to the second input end of the filtering unit, the first output end of the voltage regulating unit is electrically connected to the first DC output end, and the second output end of the voltage regulating unit is electrically connected to the second DC output end.

8. The LED driving circuit according to claim 7, wherein the voltage regulating unit comprises a first control chip and a transformer; wherein a first end of a primary coil of the transformer is electrically connected to the first output end of the filtering unit through a first diode, and a second end of the primary coil is electrically connected to the second DC output end; and a signal input end of the first control chip is electrically connected to the first end of the primary coil of the transformer, and a signal output end of the first control chip is electrically connected to the second output end of the filtering unit; the first control chip is configured to control voltage output by the voltage regulating unit.

9. The LED driving circuit according to claim 8, wherein the driving module further comprises a frequency detection unit and a switch unit; the first control chip further comprises a control signal input end; wherein an input end of the frequency detection unit is electrically connected to the second AC input end, and a control signal output end of the frequency detection unit is electrically connected to the control signal input end of the first control chip and a control end of the switch unit; and a first end of the switch unit is electrically connected to the second end of the primary coil of the transformer, and the second end of the switch unit is electrically connected to the first earth wire.

10. The LED driving circuit according to claim 8, further comprising a second protection unit which comprises an input end and a grounding end, wherein the input end of the second protection unit is electrically connected to the second input end of the filtering unit; the second protection unit is configured to detect an impedance of the second input end of the filtering unit to ground; the second input end of the filtering unit is connected or disconnected to the groung depending on the detected impedance.

11. A light tube, comprising a first pin, a second pin and the LED driving circuit according to claim 1, wherein the first pin is electrically connected to the first AC input end of the driving circuit, and the second pin is electrically connected to the second AC input end.

12. An illumination device, comprising a ballast and the light tube according to claim 11, wherein the ballast comprises a first connection end, a second connection end, a first output end and a second output end, and wherein the first connection end and the second connection end of the ballast are connected to a mains, the first output end of the ballast is electrically connected to the first pin of the light tube, and the second output end of the ballast is electrically connected to the second pin of the light tube.

* * * * *